United States Patent [19]

Armstrong et al.

[11] 4,059,389

[45] Nov. 22, 1977

[54] PHOTOFLASH LAMP AND METHOD OF MAKING SAME

[75] Inventors: Donald E. Armstrong, Williamsport; Ronald E. Sindlinger, Muncy; Bernard Cohen; John E. Tozier, both of Williamsport, all of Pa.; Emery G. Audesse, Beverly, Mass.

[73] Assignee: GTE Sylvania Incorporated, Stamford, Conn.

[21] Appl. No.: 721,604

[22] Filed: Sept. 7, 1976

[51] Int. Cl.[2] ..... F21K 5/02

[52] U.S. Cl. ..... 431/95 R

[58] Field of Search ..... 431/95, 95 A

[56] References Cited

U.S. PATENT DOCUMENTS

| | | | |
|---|---|---|---|
| 2,651,189 | 9/1953 | Beese | 431/95 |
| 3,873,261 | 3/1975 | Cote | 431/95 |
| 4,008,040 | 2/1977 | Murray et al. | 431/95 |

*Primary Examiner*—Carroll B. Dority, Jr.
*Attorney, Agent, or Firm*—Edward J. Coleman

[57] ABSTRACT

A high-voltage type photoflash lamp filled with a filamentary combustible material and oxygen and having a beadless ignition structure comprising a pair of spaced apart lead-in wires with spherically shaped terminations, a glass frit coating over the lead-in wires with scraped-off portions exposing the bare metal of the wire adjacent each termination, and a coating of primer material over the frit-coated terminations and bared portions of the wires. The primer may bridge the wire terminations or comprise separate spaced apart coatings on the respective terminations, with the filamentary combustible being in contact with both terminations to provide a conducting path therebetween. The frit coating is thick enough to prevent preignition short circuits. Also disclosed is a method of making the lamp including the steps of applying a flame to melt down the ends of the lead-in wires to provide smooth and rounded terminations, dipping the wires in a liquid suspension of glass frit, air drying, passing a blade between the wires to scrape away portions of the frit coating and expose bare wire adjacent the terminations, sealing the lead-in wires into one end of a length of glass tubing, dipping the coated lead-in wires into a primer cup to provide a coat of primer over the terminations and scraped portions, and then finishing the lamp.

37 Claims, 9 Drawing Figures

PHOTOFLASH LAMP AND METHOD OF MAKING SAME

BACKGROUND OF THE INVENTION

This invention relates to photoflash lamps and, more particularly, to flashlamps of the type containing a primer bridge, or the like, ignited by a high voltage pulse.

Such flashlamps typically comprise a tubular glass envelope constricted and tipped off at one end and closed at the other end by a press seal. A pair of lead-in wires pass through the glass press and terminate in an ignition structure including a glass bead, one or more glass sleeves, or a glass reservoir of some type. A mass or primer material contained on the bead, sleeve or reservoir bridges across and contacts the ends of the lead-in wires. Also disposed within the lamp envelope is a quantity of filamentary metallic combustible, such as shredded zirconium or hafnium foil, and a combustion-supported gas, such as oxygen, at an initial fill pressure of several atmospheres.

Lamp functioning is initiated by application of a high voltage pulse (e.g., several hundred to several thousand volts, as for example, from a piezoelectric crystal) across the lamp lead-in wires. The mass of primer within the lamp then breaks down electrically and ignites; its deflagration, in turn, ignites the shredded combustible which burns actinically.

The fabrication and testing of a number of different ignition structures has shown several problem areas that are peculiar to high voltage type flashlamps, and which are familiar to those skilled in the art of flashlamp design. For example, random location of the shreds of metallic combustible can cause short circuiting of the lead-in wires or interfere with the intended electrical breakdown path through the primer.

An example of a prior art lamp structure directed to overcoming some of those problems is described in U.S. Pat. No. 3,873,260 to Cote wherein one of the lead-in wires of the ignition mount is recessed in a glass insulating sleeve which is sealed to the press at one end and open at the other end. The other lead-in wire is formed so that it rests against and terminates slightly above the open end of the sleeve. The mass of primer material is disposed to cover the open end of the sleeve and bridge the ends of the lead-in wires. The glass sleeve has a side vent opening for the purpose of avoiding air entrapment during primer application to assure the primer material reaches the sleeved lead. Such a vent hole, however, introduces a degree of added cost and exposes the sleeved lead-in wires to a possible shred shorting condition. Consequently, an alternative approach that has been employed is to use a continuous sleeve, with no venthole. But this last-mentioned mount design also has some apparent shortcomings. The fact that the sleeved lead-in wire is recessed causes problems with primer bridging. It is necessary to use air pressure to force primer into the glass sleeve to contact the lead. This method consists of a seal connecting the top edge of the primered bottles and using the same seal as a means to force primer into the sleeve. Poor sealing of the bottle caused by a slight chip in the glass, worn or torn sealing edge, etc., can cause splashed primer and primer not contacting the lead in the sleeve. Another criticism of the prior construction is the possibility of shreds getting into the sleeve opening. Since the primer is being forced into the sleeve, an opening can appear in the primer, enhancing the possibilities of shred shorts. Further, the glass insulating sleeve is expensive and requires a special mount shaped for proper support and dimensional control. This can result in an unbalanced stress condition after sealing into the glass envelope, which then requires special annealing.

Another prior art lamp structure of interest is described in U.S. Pat. No. 3,884,615 of Sobieski wherein the two lead-in wires of the ignition mount are sealed into a doughnut-shaped glass bead which is open at both ends. The central opening in the lead is filled with a mass of primer material which bridges the lead-in wires. This construction uses the bead as a shield to keep the combustible fill away from the bare lead wires below the bead. The bead obviously must be smaller than the inside diameter of the lamp envelope. However, this creates a space for strands of fill to slip past the bead and come in contact with the lead wires, thereby shorting out the system and rendering the lamp inoperable. The close proximity of the bead and lamp envelope requires precise mount placement in order to prevent the bead from being sealed in the lamp envelope, thus weakening the final product. The Sobieski patent does disclose alternatives to counter the shred short problem, such as the use of a sleeve below the bead or special bead shaping, but such design adds to the cost of a bead structure, which is in itself comparatively expensive, and introduces additional manufacturing problems. Primer application to this structure is also difficult, requiring the use of a dip rod technique as compared to a dip cup that can be used with the construction of the aforementioned Cote patent. Another difficulty with this construction is the additional cooling time required in lamp pressurizing due to the slow transfer of heat from the bead through the inner lead wires.

SUMMARY OF THE INVENTION

In view of the foregoing, it is an object of the invention to provide an improved photoflash lamp with a more reliable ignition means.

A further object is to provide a high-voltage type flashlamp having an ignition structure with improved resistance to shred-fill shorts prior to flashing.

Yet another object is to provide a high voltage type flashlamp which may be economically produced with comparative ease in a high volume manufacturing process.

Still another object of the invention is to provide an improved method of making a photoflash lamp.

These and other objects advantages and features are attained in an ignition structure comprising a pair of spaced apart metal lead-in wires each having a smooth and rounded termination of larger diameter than the remainder of the wire. An insulting material is coated on substantially the full length within the envelope of at least one of the lead-in wires, and preferably both wires, for preventing preignition short circuits through filamentary combustible material in the envelope. Primer material is coated about the rounded terminations of the lead-in wires, and over any insulating coatings thereon, and may either bridge the wires or comprise separated spaced apart coatings. In the latter instance, the filamentary combustible material is in contact with both primer coatings so as to provide a conducting path therebetween.

Preferably, each of the lead-in wire terminations has a generally spherical shape with a diameter of about two to three times the diameter of the remainder of the wire. The preferred insulating coating is glass frit having a thickness of at least one mil. To ensure reliable operation, selected portions of the lead-in wires adjacent to the spherical terminations may be uncoated with glass frit, such as by scraping, to expose the bare metal wire. These scraped-off areas are covered with the primer material to provide insulation prior to use and facilitate ignition when the lamp is energized. The spherically shaped terminations serve two principal purposes, one of which is to eliminate sharp metal edges and burrs that may project through the frit coating and cause shorting with the filamentary combustible and, secondly, to act as an umbrella for providing large areas of contact between the primer and filamentary combustible yet protecting the scraped-off portions of the frit-coated lead-in wires immediately below the spherical terminations. That is, the enlarged spherical terminations tend to prevent the filamentary combustible material from contacting the areas of primer coating directly covering the scaped-off portions of the wires.

The ignition construction according to the invention has been observed to significantly improve high voltage lamp reliability in two key respects. Firstly, the frit coating, smooth and rounded terminations, and location of scraped-off areas has reduced the incidence of shorts before flashing to a fraction of that experienced with lamps having the aforementioned sleeve-type primer bridge structure. Secondly, the frit undercoat on the primered terminations results in a significantly higher breakdown voltage for ignition. Typically, the breakdown voltage is nearly double that required for the above-mentioned sleeve-type structure. This characteristic significantly reduces the incidence of inadvertent flashing due to stray static charges.

The lead-in wires of the ignition structure according to the invention are supported solely by the end seal of the envelope. Accordingly, the manufacturing and materials cost of incorporating a glass sleeve or bead is eliminated and the heat sinking effect of the mount structure is reduced to provide additional combustion efficiency. The internal seal strength is also improved at the wire-glass interface. During press forming of the prior art sleeved-lead lamps, the glass at the interference being cooler, tends to form V-shaped or reentrant seal angles which localize tension stress concentrations. In our lamps, however, the frit leads get hotter and the frit glass cures and actually flows at the wire-glass interface forming a smooth filet or radius with the lamp vessel, thus resulting in a greatly reduced tensile stress area.

After flashing, the residual heat of combustion melts the interior lead-in wires together into a mass at the bottom of the lamp envelope which is sufficiently conductive to high voltage pulses to permit use of the lamp as a switching means in a series circuit of an array of such lamps.

The method of making the lamps is particularly well adapted to high volume manufacturing and includes the steps of applying a flame to melt down the ends of the lead-in wires to provide smooth and rounded terminations, dip-coating the lead-in wires with glass frit, sealing the wires into one end of a length of glass tubing, dip-coating the ends of the frit-coated wires with primer, and finishing the lamp. According to a preferred embodiment, after dip coating the wires with glass frit and air drying, a blade is passed between the pair of wires to scrape off a portion of the frit coating on each wire to expose an area of bare metal adjacent to each smooth and rounded termination, the subsequent primer dipping step providing a coating of primer material over the scraped-off areas. Visual inspection of the lamps to assure primer coverage is particularly facilitated by the fact that the glass frit has a white appearance whereas the primer material is black.

By way of restatement, the major problem with prior high voltage flashlamp designs has been the criticality of construction and resulting touchy operation. This had led to comparatively poor reliability, added cost and difficulty in producing both the lamps and the photoflash units into which the lamps are assembled. The beadless lamp of the present invention provides a uniquely simplified high voltage construction which significantly reduces both the cost and difficulty of manufacture, substantially diminishes the criticality factor, and exhibits significant gains in both the efficiency and reliability of operation. One might term this breakthrough as the first truly practical high voltage flashlamp construction for a high volume, low cost consumer product.

BRIEF DESCRIPTION OF THE DRAWING

This invention will be more fully described hereinafter in conjunction with the accompanying drawings, in which.

DESCRIPTION OF THE PREFERRED EMBODIMENT

Figure 1:
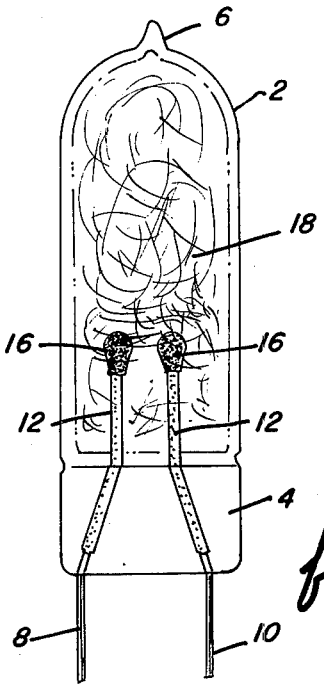
FIG. 1 is an elevational view of one embodiment of a photoflash lamp in accordance with this invention, wherein primer coatings on the lead-in wires are spaced apart without bridging.
Figure 3:
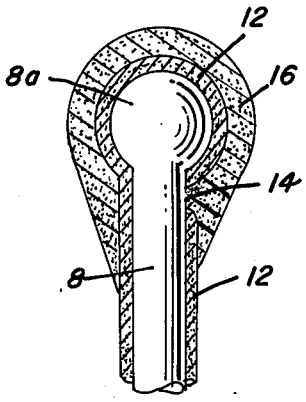
FIG. 3 is a fragmentary vertical sectional view on an enlarged scale of the end portion of one of the lead-in wires in FIG. 2.
Figure 2:
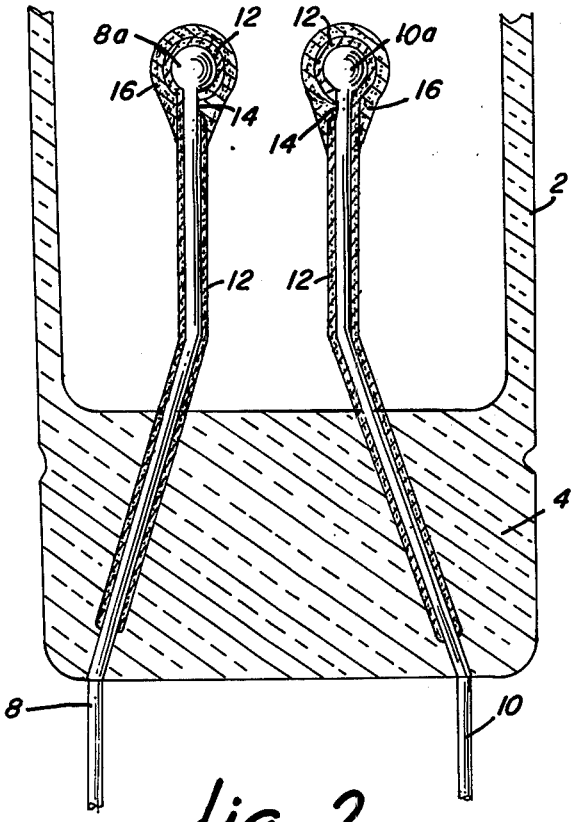
FIG. 2 is a fragmentary vertical sectional view of an enlarged scale of the inlead and ignition means construction of the lamp of FIG. 1.

Referring to FIGS. 1, 2, and 3, the high-voltage type flashlamp illustrated therein comprises an hermetically sealed light-transmitting envelope 2 of glass tubing having a press 4 defining one end thereof and an exhaust tip 6 defining the other end thereof. Supported by the press 4 is an ignition means including a pair of metal lead-in wires 8 and 10 extending through and sealed into the press in a spaced apart relationship. In accordance with the invention, the ends of the lead-in wires within the envelope are provided with smooth and rounded terminations 8*a* and 10*a* (FIG. 2) of substantially spherical shape. The diameter of each termination preferably is about two to three times the diameter of the remainder of the wire. The surfaces of the lead-in wires and terminations within the envelope are coated with an insulating material of glass frit 12. The frit glass should have a mean coefficient of thermal expansion which substantially matches that of the glass envelope 2, and preferably, the glass compositions of the frit and envelope are the same. In this manner a good glass-to-metal seal is provided in the press area 4, where the frit coating 12 typically extends along the leads in lamps made according to the invention.

Figure 4:
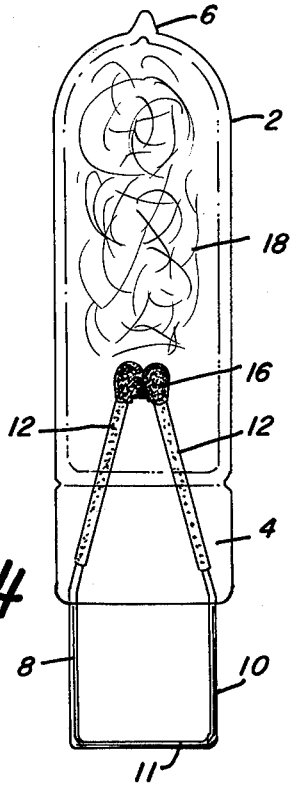
FIG. 4 is an elevational view of another embodiment of a photoflash lamp in accordance with the invention, wherein the lead-in wires are bridged with primer.

As best illustrated in FIGS. 2 and 3, a selected portion 14 on each lead-in wire adjacent to the spherical termination thereof is uncoated with the glass frit insulating material so as to expose a small area of bare metal wire through coating 12. The ignition structure is completed by a coating of primer material 16 over the spherical terminations 8*a* and 10*a* and portions of the adjacent wire. More specifically, the primer material 16 is disposed over the glass frit coating 12 and must cover the uncoated bare wire portions 14. In FIGS. 1 and 2 the respective coatings of primer material 16 on the lead-in wires 8 and 10 are spaced apart from each other. FIG. 4 illustrates an alternative approach wherein the primer material 16 bridges the terminations of the lead-in wires.

Typically, the lamp envelope 2 has an internal diameter of less than one-half inch and an internal volume of less than one cubic centimeter. A quantity of filamentary combustible fill material 18, such as shredded zirconium or hafnium foil, is disposed within the lamp envelope. The envelope 2 is also provided with a filling of combustion-supporting gas, such as oxygen, at a pressure of several atmospheres. Typically, the exterior surface of the glass envelope 2 is also provided with a protective coating, such as cellulose acetate (not shown).

Figure 5:
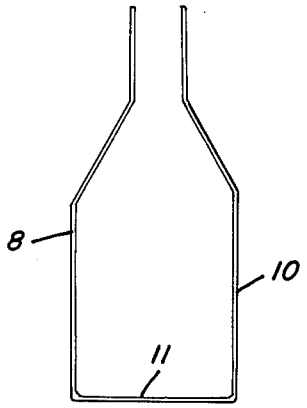
FIG. 5 illustrates the initial hairpin-shaped wire to be used in making the lamp ignition structure, the two legs of the hairpin comprising the lead-in wires.
Figure 6:
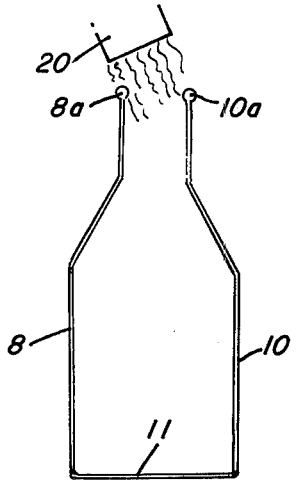
FIG. 6 illustrates the step of applying a flame to melt down the ends of the wire of FIG. 5 to provide smooth and rounded terminations.
Figure 7:
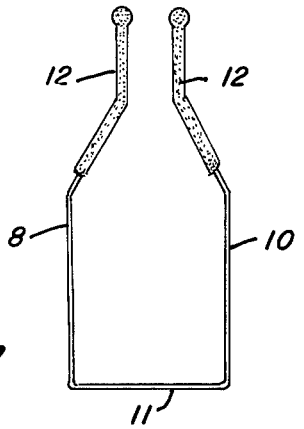
FIG. 7 illustrates the wire of FIG. 6 after dip-coating the ends thereof in a liquid suspension of glass frit and air drying.

A preferred method of making a photoflash lamp according to the invention comprises the following steps. First, providing a pair of spaced apart metal lead-in wires 8 and 10 and shaping the upper portions thereof as shown in FIG. 5. Preferably, as illustrated, the lead-in wires comprise the two legs of generally hairpin-shaped wire having a bight 11 electrically interconnecting the wires 8 and 10. A flame from a source 20 is applied to the ends of the lead-in wires, as shown in FIG. 6, to cause the ends of the wires to melt and provide the smooth and rounded terminations 8*a* and 10*a*. Next, the end of the lead-in wires are dipped in a liquid suspension of glass frit, comprising a fine glass powder blended with a binder, so as to provide an insulating coating 12 on the terminations 8*a* and 10*a* and portions of the wires 8 and 10 adjacent thereto. The frit-coated wires are then air dried, with the result being shown in FIG. 7.

Figure 8:
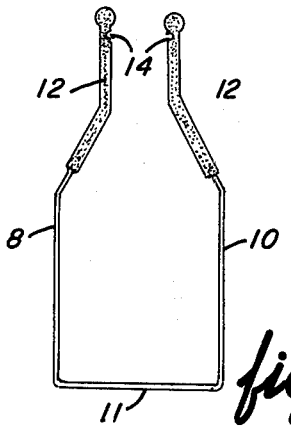
FIG. 8 illustrates the coated wire of FIG. 7 after passing a blade between the pair of wire ends to scrape off a portion of the glass frit coating of each wire and thereby expose an area of bare metal adjacent each smooth and rounded termination.

The purpose of the insulating coating 12 is to prevent preignition short circuits through the shredded foil 18. In order to provide this function reliably, we have found that the thickness of the frit coating should be at least one mil, and preferably from 1.5 to 2 mils thick. Accordingly, the preferred method includes a second dip into the liquid glass frit, followed by air drying, in order to build up the desired coating thickness. After frit-coating is completed, the next step comprises passing a blade between the pair of lead-in wires 8 and 10 to scrape off a portion of the glass frit coating on each wire and thereby expose an area 14 of bare metal adjacent to each smooth and rounded termination. As shown in FIG. 8, the result comprises opposing scraped off areas 14 on the inside of the pair of lead-in wires 8 and 10.

Figure 9:
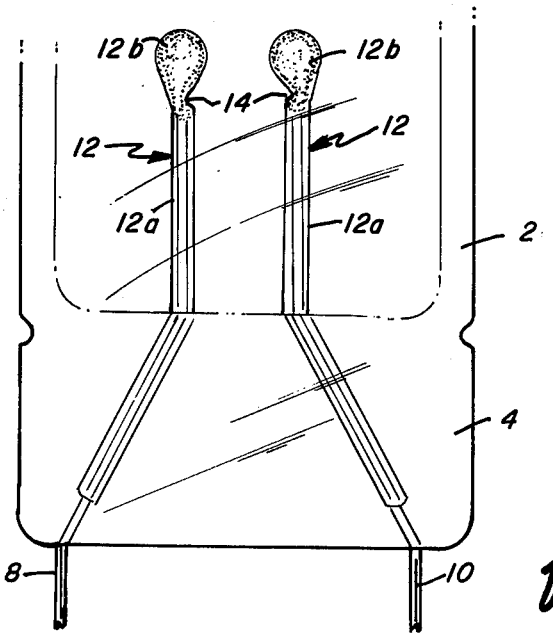
FIG. 9 is an enlarged fragmentary elevation illustrating the coated and scraped wire of FIG. 8 after pinch sealing the ends thereof into one end of a length of glass tubing.

Next, the frit-coated and scraped lead-in wires are press sealed into one end of a length of glass tubing 2 so that only frit-coated portions of the wires extend from the press 4 to within the tubing, whereby the terminations are supported in a spaced apart relationship with the tubing, as shown in FIG. 9. The heat applied to this assembly during the press sealing operation causes a fusing of the frit coating into a glassy portion 12*a*. If the lead-in wires extend above the seal in the order of one-eigth of an inch, it has been observed that the portions 12*b* of the frit about the rounded terminations will only be partially fused and have a sintered white appearance. The significance of these aspects will be discussed hereinafter.

After the press sealing step, the end portions of the frit-coated lead-in wires are dipped into a primer cup, which passes through the open end of the glass tubing, so as to apply the coating 16 of primer material about the wire terminations, as shown in FIGS. 1 or 4. In addition, the primer dipping step applies a coating of the primer material over the scraped off bare metal areas 14 on the lead-in wires, shown in FIGS. 2 and 3. The primer material typically has a black appearance, and, as previously noted, the glass frit coating is white. This color contrast is very useful in facilitating visual inspection of the lamps in high speed production to assure a proper primer coating. The envelope tubing is then filled with a quantity of filamentary combustible material 18, such as shredded zirconium, and a combustion-supporting gas, such as oxygen. The open end of the tubing is then constricted and tipped off at 6 to provide an hermetically sealed envelope 2. A protective lacquer coating is then applied to the exterior of the glass envelope, such as by dipping and drying.

After the envelope is sealed, the bight 11 of the hairpin shaped leads extends outwardly therefrom, as shown in FIG. 4. Hence, all through the lamp making process the lamp leads are interconnected by bight 11, which maintains the lamp in a disabled state for providing electrostatic protection. That is, the wire loop 11 significantly improves the resistance of the high-voltage lamp toward inadvertent ignition due to contact with the external charges. See copending application Ser. No. 630,581, filed Nov. 10, 1975, now U.S. Pat. No. 4,014,638 and assigned to the present assignee. At some time after the lacquer coating step and, preferably, just prior to attaching the lamp to an operating circuit (such as by assembly to the base or printed circuit board of a photoflash unit), the electrical interconnection (bight 11) is cut to enable the lamp so it can be fired.

Operation of such high voltage flashlamps is initiated when a high voltage pulse from, e.g., a piezoelectric crystal, is applied across the two lead-in wires 8 and 10. Electrical breakdown of the primer causes its deflagration which, in turn, ignites the shredded metallic combustible 18. The scraped off portions 14 on the lead-in wires ensure reliability of ignition by providing small areas of direct contact between the bare conductor metal and the primer. It has been observed, however, that reliable ignition can also be obtained if the scraping step is eliminated and the wires 8 and 10 within the envelope are left completely coated with frit 12, without providing uncoated areas 14. It is theorized that such ignition is effected due to the somewhat porous nature of the portions 12*b* of the frit coating which are not completely fused, as discussed hereinbefore with respect to FIG. 9. Thus, whereas the fused portions 12a are vitrified and, if thicker than one mil, provide an impermeable coating of insulating material, the coating portions 12b are permeable to an electric discharge therethrough (at the voltages typically encountered in "high voltage" photoflash applications) between the lead-in wire and primer.

In the lamp of FIG. 4 (with bight 11 removed) the spark discharge occurs through the primer bridge 16, and the shreds of foil 18 will tend to be supported in the upper portions of the envelope above the bridge. In the lamp of FIG. 1, however, the foil 18 substantially fills the envelope 2 and is contact with both of the respective primer coatings 16 so as to form an electrically conducting path therebetween for formation of a spark discharge between the lead-in wires and the foil through the respective primer coatings, upon application of a high voltage pulse across the lead-in wires. Hence, in high speed automatic production processing, it is not critical whether the primer bridges the leads or not; it is only necessary that the foil fill provide contact between the separated primer coatings.

Prior to operation, the insulating glass frit coatings 12 function to prevent preignition short circuits across the lead-in wires through the foil 18. As the primer material is initially non-conductive, it functions as an additional insulating layer, particularly over the scraped-off bare wire areas 14. The smooth and rounded terminations 8a and 10a eliminate the problem of burrs or sharp edges which might pierce through the insulation glass frit coating. The enlarged diameter of these terminations functions as an umbrella to provide both large surface areas of primer coating 16 to contact the foil 18 and a means of protecting the adjacent scraped-off areas 14. That is, the location of the bare wire areas 14 under the spherical terminations tends to preclude direct contact between the foil 18 and the primer coating 16 directly covering an area 14, whereby an inadvertent discharge could occur or undesired abrasion and removal of the primer covering on this sensitive area could result.

A particularly unexpected result of the glass frit undercoat 12 is that it has been found to nearly double the breakdown voltage of the lamp, as compared to the aforementioned high voltage flashlamp having a glass sleeve and primer bridge and intended for the same photoflash application. This high breakdown voltage has resulted in a significantly more reliable photoflash unit and a substantial reduction in production shrinkage as the lamp is rendered considerably less sensitive to inadvertent flashing due to stray static charges.

An added feature of the design is that after flashing, the residual heat of combustion melts the inner lead-in wires together into a mass at the bottom of the lamp envelope. This mass of melted metal is sufficiently conductive to the high voltage pulses applied in such photoflash applications that the lamp can be used as a switching means when employed in a series connected array of lamps, such as the arrays shown in FIG. 3 of U.S. Pat. Nos. 3,532,931 and FIG. 1 of 3,692,995. Lamps according to the invention are also useful in parallel connected lamp arrays of the type employed in a currently marketed photoflash unit referred to as a flip flash, provided quick-disconnect switches are used as described in application Ser. No. 614,108, filed Sept. 17, 1975, now U.S. Pat. No. 4,017,728 and assigned to the present assignee.

In one specific embodiment of the invention, a high voltage flashlamp of the type shown in FIG. 1 was provided with an envelope 2 formed from 0.259 inch O.D. tubing of borosilicate glass known commercially as Corning type 7073 glass, which has a mean coefficient of thermal expansion of about $53.5 \times 10^{-7}$ in./in./°C between 0° C and 300° C and a glass composition by weight, of approximately: 63.4% $SiO_2$, 7.2% $Al_2O_3$, 17.8% $B_2O_3$, 0.6% LiO, 3.9% $Na_2O$, 4.6% $K_2O$, 2.2% BaO, and 0.2% Cl. The internal volume was 0.35 $cm^3$; the quantity of combustible material was 12.5 mgs. of four inch long zirconium shreds having a cross section of 0.0008 inch × 0.001 inch; the oxygen fill pressure was 950 cm. Hg absolute. The lead-in wires 8 and 10 were 0.014 inch in diameter and formed of a metal alloy of iron, nickel and cobalt, which is known commercially as Rodar or Kovar. This alloy has a composition which is approximately 54% Fe, 29% Ni, 17% Co, <0.5% Mn, <0.2% Si, and <0.06% C and a mean coefficient of thermal expansion of about $50 \times 10^{-7}$ in./in./°C between 25° C and 300° C. The diameter of each of the spherical terminations 8a and 10a melted at the ends of the wires was about 0.032 to 0.035 inch. The coating of glass frit 12 was from 1.5 to 2 mils thick and applied by dipping the ends of the lead-in wire twice into a liquid suspension of glass frit consisting of a fine powder of type 7073 glass blended with a binder of amyl acetate and nitrocellulose. After air drying of the frit, the leads were scraped at the location 14 (FIG. 2) to expose small areas of bare wire. Approximately 2 mgs. of primer 16 was used for each lamp; the lead ends were dip-coated with the primer to provide an average thickness of about 1.5 to 2 mils and the coverage illustrated in FIGS. 2 and 3. One suitable primer composition comprises about 99.0 percent by weight of zirconium powder and 1.0 percent by weight cellulose nitrite on a dried basis. A protective coating of cellulose acetate lacquer was provided on the exterior of the envelope.

The above-described ignition structure may also be employed in flashlamps having envelopes comprised of G-1 type soft glass having a coefficient of thermal expansion within the range of 85 to $95 \times 10^{-7}$ in./in./°C between 20° and 300° C. In this instance, the glass frit would contain type G-1 or G-8 glass powder. Typically, Dumet wire is employed for the leads of a soft glass flashlamp to provide the desired glass-to-metal expansion match. Dumet wire, however, comprises a nickel-iron alloy which is coated with a thin film of copper; when the ends of this wire are melted down, the copper sheathing prevents the formation of the desired spherical shaped terminations 8a and 10a. Accordingly, when using a soft glass envelope, it is preferred that the lead-in wires 8 and 10 be formed of a nickel-iron alloy referred to as 52 alloy, which has a mean coefficient of thermal expansion of about $101.0 \times 10^{-7}$ in./in./°C between 25° and 300° C. The ends of the 52 allow wire form smooth and rounded terminations of enlarged diameter when melted down.

Although the invention has been described with respect to a specific embodiment, it will be appreciated that modifications and changes may be made by those skilled in the art without departing from the true spirit and scope of the invention. For example, it is only necessary to coat one of the lead-in wires with glass frit insulation, although the described dip-coating method renders the covering of both leads the most feasible approach. Clearly, the concept is also applicable to axial lamps with the two lead-in wires entering opposite ends thereof. Further, the scraped-off areas 14 may be located on the outside surfaces of the pair of wires, rather than an opposing inside areas. On the other hand, both the inside and outside surfaces may be scraped.

What we claim is:

1. A photoflash lamp comprising:

an hermetically sealed, light-transmitting envelope;

a quantity of filamentary combustible material located within said envelope;

a combustion supporting gas in said envelope;

and ignition means disposed in said envelope in operative relationship with respect to said filamentary combustible material, said ignition means including a pair of lead-in wires sealed through and extending inside said envelope in a spaced apart relationship, the termination of each of said lead-in wires within said envelope having a smooth and rounded configuration of larger diameter than the remainder of the wire, an insulating material coated on substantially the full length within said envelope of at least one of said lead-in wires for preventing preignition short circuits through said filamentary combustible material, and primer material coated about the smooth and rounded terminations of said lead-in wires, the primer coating on the insulatingly coated lead-in wire being disposed over said coating of insulating material.

2. The lamp of claim 1 wherein the diameter of the smooth and rounded termination of each of said lead-in wires is about two to three times the diameter of the remainder of the wire.

3. The lamp of claim 1 wherein said insulating material is a coating of glass frit.

4. The lamp of claim 3 wherein at least the portion of said glass frit underneath said primer coating is white and said primer is black, thereby facilitating visual inspection of primered lamps.

5. The lamp of claim 1 wherein a selected portion of said insulatingly coated lead-in wire adjacent to the smooth and rounded termination thereof is uncoated with said insulating material and covered with said primer material.

6. The lamp of claim 5 wherein said primer material bridges the terminations of said lead-in wires.

7. The lamp of claim 5 wherein the respective primer coatings on said lead-in wires are spaced apart from each other, and said filamentary combustible material substantially fills said envelope and is in contact with both of said respective primer coatings so as to form an electrically conducting path therebetween for formation of a spark discharge between said lead-in wires and the combustible material through said respective primer coatings upon application of a high voltage pulse across said lead-in wires.

8. The lamp of claim 1 wherein the smooth and rounded termination of each of said lead-in wires has a substantially spherical configuration.

9. The lamp of claim 8 wherein said insulating material is a coating of glass frit having a thickness of at least one mil.

10. The lamp of claim 9 wherein the diameter of the spherical termination of each of said lead-in wires is about two to three times the diameter of the remainder of the wire.

11. The lamp of claim 1 wherein said pair of lead-in wires are sealed through one end of said envelope, and said end of the envelope is the sole means of supporting said lead-in wires in a spaced apart relationship within said envelope.

12. The lamp of claim 11 wherein both of said lead-in wires are coated with said insulating material over substantially the full length of said wires within said envelope, said primer coating being disposed over the coating of insulating material on each of said wires.

13. The lamp of claim 12 wherein said insulating material is a coating of glass frit.

14. The lamp of claim 13 wherein at least the portion of said glass frit underneath said primer coating is white and said primer is black, thereby facilitating visual inspection of primered lamps.

15. The lamp of claim 13 wherein said primer material bridges the terminations of said lead-in wires.

16. The lamp of claim 13 wherein selected portions of said lead-in wires adjacent to the smooth and rounded terminations thereof are uncoated with said glass frit and covered with said primer material.

17. The lamp of claim 16 wherein said selected uncoated portions of the lead-in wires comprise opposing scraped-off areas on the inside of said pair of lead-in wires.

18. The lamp of claim 13 wherein the respective primer coatings of said lead-in wires are spaced apart from each other, and said filamentary combustible material substantially fills said envelope and is in contact with both of said respective primer coatings so as to form an electrically conducting path therebetween for formation of a spark discharge between said lead-in wires and the combustible material through said respective primer coatings upon application of a high voltage pulse across said lead-in wires.

19. The lamp of claim 18 wherein the coating of glass frit on each of said lead-in wires has a thickness of at least one mil, and said coating of primer material over the coating of glass on each of said lead-in wires has a thickness of at least one mil.

20. The lamp of claim 13 wherein the smooth and rounded termination of each of said lead-in wires has a substantially spherical configuration.

21. The lamp of claim 20 wherein the coating of glass frit on each of said lead-in wires has a thickness of at least one mil.

22. The lamp of claim 21 wherein the diameter of the spherical termination on each of said lead-in wires is about two to three times the diameter of the remainder of the wire.

23. The lamp of claim 22 wherein said lead-in wires are composed of a nickel-cobalt-iron alloy or a nickel-iron alloy.

24. The lamp of claim 13 wherein said envelope is glass, and a mean coefficient of thermal expansion of said frit glass is substantially matched to the glass of said envelope.

25. The lamp of claim 24 wherein the composition of the glass in said frit coating is the same as the glass composition of said envelope.

26. A method of making a photoflash lamp comprising:

applying a flame to the ends of a pair of spaced apart metal lead-in wires to cause said ends of the wire to melt and provide smooth and rounded terminations;

dipping said lead-in wires in a liquid suspension of glass frit, comprising a fine glass powder blended with a binder, so as to coat said terminations and portions of the wires adjacent thereto;

air drying said frit-coated wires;

sealing said lead-in wires into one end of a length of glass tubing so that only frit-coated portions of the wires extend from the seal to within the tubing, whereby said terminations are supported in a spaced apart relationship within said tubing;

dipping the end portions of said frit-coated lead-in wires into a primer cup so as to apply a coating of primer material about said wire terminations;

filling said glass tubing with a quantity of filamentary combustible material and a combustion-supporting gas;

tipping off the tubing to provide an hermetically sealed envelope; and applying a protective coating on the exterior of said envelope.

27. The method of claim 26 wherein said pair of lead-in wires comprise the two legs of a generally hairpin-shaped wire, said lead-in wires are sealed into one end of said glass tubing with the bight of said hairpin extending outwardly therefrom, and further including the step of cutting said bight of the hairpin-shaped wire to enable said lamp after coating the envelope and before attaching the lamp to an operating circuit.

28. The method of claim 26 wherein the smooth and rounded termination of each of said melted lead-in wires has a substantially spherical configuration with a diameter of about two to three times the diameter of the remainder of the wire.

29. The method of claim 26 including the further step, after air drying the frit-coated wires and before sealing, of passing a blade between said pair of lead-in wires to scrape off a portion of the glass frit coating on each wire and thereby expose an area of bare metal adjacent to each smooth and rounded termination, and whereby said primer dipping step applies a coating of primer material over said scraped-off bare metal areas on the lead-in wires.

30. The method of claim 26 wherein the mean coefficient of thermal expansion of said frit glass is substantially matched to the glass of said tubing.

31. The method of claim 30 wherein the composition of the glass powder in said frit coating is the same as the glass composition of said tubing.

32. The method of claim 31 wherein the binder of said liquid suspension of glass frit is amyl acetate and nitrocellulose.

33. The method of claim 26 wherein said air dried frit coating is white and said primer material is black, thereby facilitating visual inspection of primer coated lamps.

34. The method of claim 26 wherein said primer dipping step provides a coating of primer material bridging the terminations of said lead-in wires.

35. The method of claim 26 wherein said primer dipping step provides separate spaced apart primer coatings on said lead-in wires.

36. The method of claim 26 wherein said sealing of the lead-in wires in the tubing provides a press seal.

37. The method of claim 26 including the further steps, after air drying said frit-coated wires, of dipping said lead-in wires a second time into said liquid glass frit and then air drying so as to provide a total frit coating thickness of greater than one mil.

* * * * *